US005464062A

United States Patent [19]

Blizzard, Jr.

[11] Patent Number: 5,464,062

[45] Date of Patent: Nov. 7, 1995

[54] METAL-TO-METAL SEALABLE PORT

[75] Inventor: William A. Blizzard, Jr., Houston, Tex.

[73] Assignee: Weatherford U.S., Inc., Houston, Tex.

[21] Appl. No.: 321,557

[22] Filed: Oct. 12, 1994

Related U.S. Application Data

[62] Division of Ser. No. 82,256, Jun. 23, 1993, Pat. No. 5,368, 098.

[51] Int. Cl.[6] ..... E21B 29/00

[52] U.S. Cl. ..... 166/376; 166/100

[58] Field of Search ..... 166/317, 74, 100, 166/242, 296, 376, 382, 383

[56] References Cited

U.S. PATENT DOCUMENTS

| | | | |
|---|---|---|---|
| 1,527,749 | 2/1925 | Raymond | 166/153 |
| 2,109,058 | 2/1938 | Blee | 166/117 |
| 2,196,657 | 4/1940 | Burt | 166/115 |
| 2,263,566 | 11/1941 | Boynton | 166/150 |
| 2,602,510 | 6/1952 | Baker | 166/156 |
| 2,662,599 | 12/1953 | Baker | 166/156 |
| 2,707,997 | 5/1955 | Zandmer et al. | 166/100 X |
| 2,775,304 | 12/1956 | Zandmer | 166/100 |
| 2,928,470 | 3/1960 | Baker | 166/154 |
| 3,006,415 | 10/1961 | Burns et al. | 166/156 |
| 3,120,268 | 2/1964 | Caldwell | 166/100 |
| 3,159,219 | 12/1964 | Scott | 166/156 |
| 3,419,089 | 12/1968 | Venghiattis | 166/100 X |
| 3,437,137 | 4/1969 | Scott | 166/153 |
| 3,524,503 | 8/1970 | Baker | 166/289 |
| 3,528,498 | 9/1970 | Carothers | 166/55 |
| 3,581,817 | 6/1971 | Kammerer, Jr. | 166/212 |
| 3,730,267 | 5/1973 | Scott | 166/335 |
| 3,749,119 | 6/1973 | Tausch et al. | 137/461 |
| 3,768,556 | 10/1973 | Baker | 166/154 |
| 3,811,500 | 5/1974 | Morrisett et al. | 166/154 |
| 3,842,905 | 10/1974 | Morrisett et al. | 166/155 |
| 3,924,677 | 12/1975 | Prenner et al. | 166/100 |
| 3,948,322 | 4/1976 | Baker | 166/289 |
| 4,175,619 | 11/1979 | Davis | 166/291 |
| 4,176,717 | 12/1979 | Hix | 166/289 |
| 4,246,968 | 1/1981 | Jessup et al. | 166/334 |
| 4,286,662 | 9/1981 | Page, Jr. | 166/317 |
| 4,356,867 | 11/1982 | Carmody | 166/373 |
| 4,385,663 | 5/1983 | Hutchison | 166/387 X |
| 4,390,186 | 6/1983 | McGee et al. | 166/195 X |

(List continued on next page.)

FOREIGN PATENT DOCUMENTS

PCT/EP89/ .01219 10/1988 WIPO .

OTHER PUBLICATIONS

"Sales Technical Data Halliburton's Non-Rotating Cementing Plugs," Halliburton Services, 1989.

"Oil Well Cementing Practices In The United States, " American Petroleum Institute, 1959, p. 112.

"Subsurface Safety Systems Catalog," Camco, pp. 46–47, 1991.

"Packers And Completion Accessories Catalog," Camco, pp. 80–81, 1991.

"Sales & Service Catalog 43," Halliburton Services, 1986.

"Chapter 10 Primary Placement Techniques," Dowell Schlumberger, Cementing Technology, 1984.

"Primary Cementing Equipment," Gemoco, 1991.

"Float Equipment," Gemoco, p. 2213, 1986.

"Conventional and Specialized Float Equipment," Weatherford, 1985.

"General Services and Products Catalog 1988–89" Weatherford, 1988.

"Metallic Sealing Technology In Downhole Completion Equipment", Blizzard, JPT, Oct. 1990 (pp. 1244–1247).

*Primary Examiner*—Roger J. Schoeppel
*Attorney, Agent, or Firm*—Guy McClung

[57] ABSTRACT

A ported fluid flow member has been developed in which one or more ports each is lined with a metal tube which has a portion projecting into the body member. The projecting portion may be crushed shut forming a metal-to-metal seal to seal off the corresponding port to flow. Methods have been invented for using the items with one or more of the lined ports.

4 Claims, 6 Drawing Sheets

U.S. PATENT DOCUMENTS

| | | | |
|---|---|---|---|
| 4,411,316 | 10/1983 | Carmody | 166/323 |
| 4,421,165 | 12/1983 | Szarka | 166/151 |
| 4,487,263 | 12/1989 | Jani | 166/289 |
| 4,674,569 | 6/1987 | Revils et al. | 166/154 |
| 4,706,747 | 4/1987 | Schneider | 166/153 |
| 4,711,300 | 12/1987 | Wardlaw et al. | 166/153 |
| 4,749,047 | 6/1988 | Taylor | 166/387 X |
| 4,796,705 | 1/1989 | Carmody et al. | 166/323 |
| 4,836,279 | 6/1989 | Freeman | 166/153 |
| 4,842,062 | 6/1989 | Schneider et al. | 166/154 |
| 4,911,243 | 3/1990 | Adamek et al. | 166/387 |
| 4,944,351 | 6/1990 | Eriksen et al. | 166/326 |
| 4,981,177 | 1/1991 | Carmody et al. | 166/376 |
| 5,038,862 | 8/1991 | Giroux et al. | 166/289 |
| 5,095,980 | 3/1992 | Watson | 166/192 |
| 5,181,568 | 1/1993 | McCoy et al. | 166/194 X |
| 5,211,243 | 5/1993 | Strattan | 166/374 |
| 5,228,518 | 7/1993 | Wilson et al. | 166/100 |
| 5,284,205 | 2/1994 | Smith | 166/72 |
| 5,318,122 | 6/1994 | Murray et al. | 166/50 X |
| 5,364,110 | 11/1994 | Streich et al. | 277/115 |
| 5,368,098 | 11/1994 | Blizzard et al. | 166/317 X |

METAL-TO-METAL SEALABLE PORT

RELATED APPLICATION

This is a division of U.S. Ser. No. 08/082,256 filed on Jun. 23, 1993 entitled "Stage Tool", now U.S. Pat. No. 5,368,098.

BACKGROUND OF THE INVENTION

1. Field of the Invention

This invention is directed to ported tubular members; to such tubulars for use in a wellbore; to a fluid port with a metal-to-metal seal; to port closing systems; and to stage tools for use in wellbores.

2. Description of Related Art

Various downhole tools used in the oil and gas industry provide a fluid passageway from inside a conduit (casing or tubing), through its wall, and then outside of the conduit. This passageway is initially open and then closed, or is initially closed then opened. The object is to provide a "gateway" for fluid transfer from inside a conduit to outside. This gateway is found on many tools such as including but not limited to port collars, stage tools, combination packoff stage tools, liner sleeves, and sliding sleeves. It is desirable for this type of gateway that it be effectively sealed once closed; for example, when the gateway is incorporated into a conduit which is subsequently cemented into place such as oil and gas well casing. This conduit is meant to be a permanent placement of a pressure barrier into the earth, sealing off potentially harmful fluids and dangerous pressure. If a gateway leaks after being closed, substantial costs are incurred in retrieving the cemented casing. Typically, relatively affordable polymeric seals are utilized in these types of downhole products.

A drilled wellbore hole is prepared for oil or gas production by cementing casing, liners or similar conduit strings in the wellbore. Cementing is the process of mixing a composition including cement and water and pumping the resulting slurry down through the well casing and back up into the annulus between the casing and the wellbore. Cementing of the annulus provides protection from the intermixing of the contents of various production zones which could result in undesirable contamination of produced oil or gas or in contamination of the producing strata.

In the early days of the oil field industry, the shallower wells allowed cementation to be accomplished by pumping a cement slurry down the well casing, out the casing bottom, and back up the annular space between the bore hole and casing. As wells were drilled deeper, the cementing process was accomplished in two or even three stages. Cementing tools, stage tools, or ported collars equipped with internal valving, were used for multi-stage cementation. Typically, the internal valving of cementing tools, or stage tools, consist of one or more sliding sleeve valves for the opening and closing of the cement ports before and after a cement slurry has passed through the ports. A variety of plugs are used to aid multi-stage cementing to open and close the correct sleeve valve at the correct time.

The sleeve valves are typically shear-pinned in an upper position with the lowermost sleeve sealing the ports closed for running in the wellbore hole. When stage cementing is desired, an opening plug is moved, or dropped and gravitated, to seat and seal off the lowermost sleeve. Pressure applied at the surface applies enough downward force on the plug and seat arrangement to break the shear pins and shift the lower sleeve valve down, thus opening ports which allow cementing solutions or slurries to flow down the interior of the casing and then through the ports into the annulus between the exterior of the casing and the interior of the wellbore. Cement is pumped down the casing, through the ports and back up the annulus.

As the tail end of the cement slurry is pumped down the casing, a second plug often called a "closing plug" is placed into the casing behind the cement. This plug moves down to seat and seal off the uppermost sleeve valve until sufficient surface casing pressure is applied to break the shear pins holding the sleeve. The upper sleeve and plug shift downward to cover and seal off the ports so that no more solution or slurry passes either into the annulus or back from the annulus. An engaging mechanism has been used to lock the closing sleeve in position.

Prior art downhole tools such as safety valves have incorporated into their design valving components which shut off flow through a passageway. Such safety valves usually have control line tubing which routes hydraulic fluid for controlling the valve through a particular passageway. This passageway may allow fluid downhole to another valve for alternate valve operation. When a lower valve is no longer required, the passageway is required to be terminated. One method of termination utilizes a metal plunger and polished seal bore. Hydraulic fluid travels around the plunger and into the seal bore and on downstream to further perform a function. Once the passageway is no longer desired, the metal plunger is forceably driven into the bore, sealing off the passageway. This method is unsatisfactory due to the high degree of smoothness, as well as the tight tolerances required for an interference metal-to-metal seal. In addition, such closure mechanisms are susceptible to damage on their smooth sealing surfaces under abrasive flow. Interference plungers may not provide enough metal flow for total filling of all minute scratches and abrasions inherent with this mechanism.

Another method of terminating the passageway in a valve is to crimp and sever a control line as in U.S. Pat. No. 4,981,177. This method requires crimping and severing of the control line to occur substantially simultaneously.

There has long been a need for ported tubular members in which the port(s) may be efficiently and effectively sealed. There has long been a need for such members in which a metal-to-metal seal is created. There has long been a need for a stage tool with such ports.

SUMMARY OF THE PRESENT INVENTION

After cementing a well, it is desirable to minimize potential leaks in the casing string. It has been well known and documented that metal seals outperform polymeric seals in downhole applications, particularly in severe service where high pressures, corrosion and high temperatures are involved. Metal Seals are difficult to achieve in downhole equipment since most components are tubular in shape with little room to place any sealing arrangements. Typical sealing components, e.g. O-rings, are shaped into large diameters and placed between concentric sleeves. Metal seals which are large in diameter and seal between sleeves do not perform well downhole. The sealing diameters often are damaged either during assembly or once downhole, and metal seals of this nature may not undergo total metal "flow" of the sealing surfaces, a primary requirement for properly designed metal seals.

Many concentric metal seal arrangements require close tolerances and smooth finishes on the sealing components.

In addition, the metal seals themselves are coated with exotic materials such as gold or silver to help achieve metal flow required for sealing. In large size concentric sleeves it is very difficult to achieve accurate concentricity and roundness.

The present invention discloses, in one embodiment, a tubular member with one or more ports. Each port is lined with a metal port liner which abuts the port's interior surface. An extended portion of the port liner extends beyond the tubular member for contact by crushing apparatus which bends the extended port liner portion against itself to form a seal and prevent fluid flow through the port.

In another embodiment the present invention discloses a cementing stage tool for use in multi-stage wellbore cementing operations. The tool includes a body member with, preferably, a lower inflatable element such as a packer and an inflation port through the body member through which inflating fluid flows to the packer. A first sleeve, a drive sleeve, is movably mounted in the body member to move to close off one or more lined ports in the body member through which cement passes to an annulus outside the body member. The tool is interposed in a casing string with a lower threaded end for threaded connection to the casing at the lower end and with, in one aspect, an upper threaded sub threadedly connectible to the tool body member at a lower end and to a casing member at an upper end. Two sleeves are movably mounted in the drive sleeve, a second sleeve, called in one aspect a communication sleeve, and a third sleeve, called in one aspect a closing sleeve. Movement of the communication sleeve permits fluid to flow through the lined port or ports. Then movement of the closing sleeve results in movement of the drive sleeve to crush a portion of each metal port liner extending into the body member to stop fluid flow through the ports. Crushing of the extending liner portions results in a metal-to-metal seal of metal surfaces of the port liner, effectively closing off the ports to flow. In one aspect the inflation port is similarly lined and movement of the drive sleeve closes it off to flow also by crushing an extending metal liner portion.

In one embodiment of a packoff stage cementing tool according to the present invention has two main structural components, an upper sub and an outer body; interior sleeves; and an inflatable elastomeric sealing element. The tool provides temporary isolation of an annulus between the casing and a drilled hole, while at the same time opening (followed by a sealing off) a cement flow passageway through the casing into the annulus above the sealing element. The tool is incorporated into the casing string by the tubular thread connection at the top and bottom of the tool. As the tool is being placed downhole with the casing, no communication exists between the interior casing and the annulus, and the inflatable sealing element is relaxed. Once the casing has been landed in its proper position downhole, first stage flow of cement commences, unobstructed down through the stage tool. After a certain amount of cement has been placed in the well, operation of the packoff stage tool then commences. The inflatable element is expanded using hydraulic pressure from the surface acting on the fluid inside the casing at the stage tool. In order to generate this hydraulic pressure, a flexible plug is pumped down immediately trailing the first stage cement. The plug bottoms out at some point below the stage tool and allows pressure buildup of the entire casing string. In an alternative embodiment a heavy solid "bomb" is dropped and falls, landing on a lowermost seat of a driving sleeve internal to the stage tool. Thus the tool is either hydraulically operated (use of flexible plug) or mechanically operated (bomb mechanically lands on sleeve). In the hydraulic operation mode, the drive sleeve has a concentric piston area made up of two differing diameters. Once pressure from inside the casing builds relative to outside the casing, the force created by the piston area acts downward. Resisting this force are shear pins holding the drive sleeve in place. At a preset force (pressure) the pins shear and the drive sleeve moves downward until lock dogs located on the upper portion of the outer body bottom out on a shoulder of the outer body. At this point an inflation port is uncovered and flow is established from inside the casing into the inflatable element cavity inflating and expanding the element out against the drilled hole wall, thus isolating the annulus above the inflatable element from the annulus below it.

If there is a problem generating pressure with the flexible plug mentioned in the hydraulic option above, a heavy metal shaped plug or "bomb" is placed in the casing at the surface and allowed to drop downward due to gravity until it rests against the shoulder of the lower portion of the drive sleeve. Once on the shoulder, a piston area is created across this bomb. Pressure from the surface now acts across this bomb, from above to below and generates a downward force acting to move the bomb and the drive sleeve downward. As in the hydraulic option, shear pins resist this movement until a preset force (pressure) is achieved. At that time the pins shear and the drive sleeve moves down opening the inflation port A communication sleeve is movably disposed in the drive sleeve above a lower seat of the drive sleeve. This sleeve covers a circumferentially spaced collection of metal tubes. These tubes act as liners to communication ports between the casing and the annulus. The communication sleeve has two differing seal diameters forming a piston area. As inflation pressure expanding the inflatable element begins to build, this same pressure acts against the communication sleeve piston generating a downward force. At a preset force (pressure), the sleeve shears a set of retaining pins and travels downward, uncovering the collection of metal tubes and communications ports and providing a passageway for the transfer flow of cement from inside the casing to the annulus. After the communication sleeve shifts, inflation pressure is no longer maintained. For this reason a check valve is placed in a passageway to the inflatable element to temporarily retain element inflation and expansion.

After a determined amount of fluid (e.g. but not limited to cement) has been transferred to the annulus, a flexible closing plug is pumped down as a trailing portion to the cement flow. When this plug reaches the tool, it lands on a closing sleeve movably disposed in the drive sleeve at the upper portion of the tool. This plug now blocks the casing bore and acts as a piston area against which to generate force. At a preset force (pressure), the closing sleeve shears a set of retaining pins and moves downward. This movement uncovers a set of locking dogs which up until this time have been forcibly held outward into an undercut on the outer body by the outer diameter of the closing sleeve. Now that these dogs are no longer supported they are forced inward due to the angle on the lower surface of the undercut. This now allows the drive sleeve to travel downwards until it bottoms out on the lowermost inner shoulder of the outer body. In moving downward, the drive sleeve folds over and, preferably, crushes flat the ends of the communication tubes, permanently sealing them off. The ends of the tube are forcibly pressed between the outside diameter of the drive sleeve and the inside diameter of the outer body. This annulus gap between diameters is preferably closed such that it is slightly smaller that the two wall thicknesses of the metal tube. In this way, a crush and seal effect is, preferably, guaranteed. In addition to sealing off the communication tubes, the drive sleeve also folds over and crushes the inflation port tube providing, preferably, permanent metal sealing of the inflation element passageway.

After the cementation of the second stage has occurred and the metal tubes are sealed off, typically the plugs and bombs left in the stage tool are drilled out. With this design what is left after drillout is total metal-to-metal sealing from inside the casing to the annulus.

In one embodiment a tool for use in wellbore operations is disclosed which has a hollow body member, at least one hollow port through the hollow body member for the passage of fluid from an interior of the body member to a space outside the body member or vice versa, the port or ports each having a central channel therethrough defined by a port interior surface and a metal liner disposed within the port and lining its interior surface, the metal liner having a crushable metal extending liner portion projecting beyond the at least one hollow port into the hollow body member which, preferably, when crushed forms a metal-to-metal seal which prevents fluid flow through the port.

It is, therefore, an object of at least certain preferred embodiments of the present invention to provide:

New, useful, unique, efficient, non-obvious lined ports, ported tubulars, and devices and methods for selective ported flow of the fluid through the wall of a tubular member or member of other shape;

Such devices and methods for effectively sealing closed a port through a wall of a member;

Such methods and devices which have an effective metal-to-metal sealing mechanism;

Such methods and devices for a multi-stage wellbore cementing stage tool;

Such devices and methods in which each port is individually sealed with relatively small seal areas and, preferably, thereby minimizing seal/contact interface; and Such devices and methods in which the pressure of fluid within the casing and the tool assists in maintaining the seals.

This invention resides not in any particular individual feature, but in the combinations of them herein disclosed and claimed and it is distinguished from the prior art in these combinations with their structures and functions.

There has thus been outlined, rather broadly, features of the invention in order that the detailed descriptions thereof that follow may be better understood, and in order that the present contributions to the arts may be better appreciated. There are, of course, additional features of the invention that will be described hereinafter and which may form the subject matter of the claims appended hereto. Those skilled in the art will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar that do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 1D is a side cross-sectional view of a closing sleeve of the tool of FIG. 1 a.

DESCRIPTION OF EMBODIMENTS PREFERRED AT THE TIME OF FILING FOR THIS PATENT

Figure 1A:
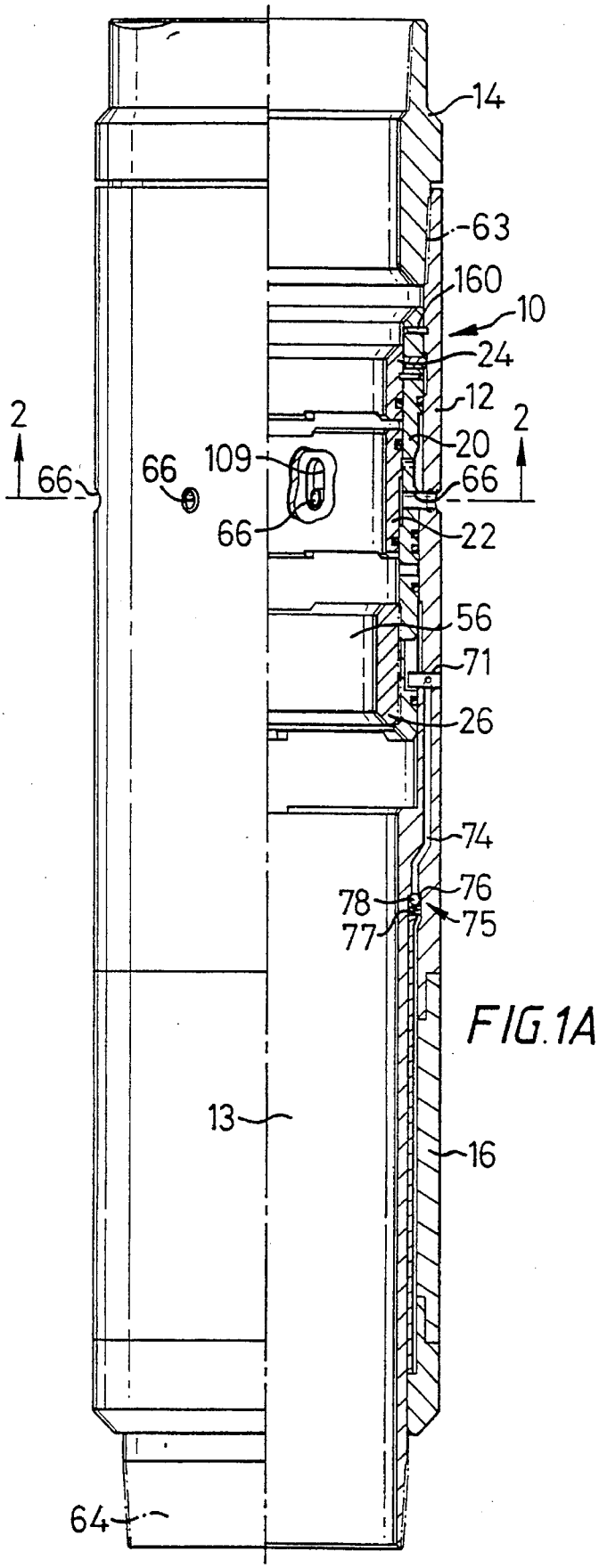
FIG. 1A is a side view, partially in cross-section, of a tool according to the present invention.

Referring now to FIG. 1, a stage tool 10 according to the present invention has a hollow body member 12 with a channel 13 through its center. A drive sleeve 20 is movably disposed within the body member 12 and both a communication sleeve 22 and a closing sleeve 24 are movably disposed within the drive sleeve 20.

Figure 1E:
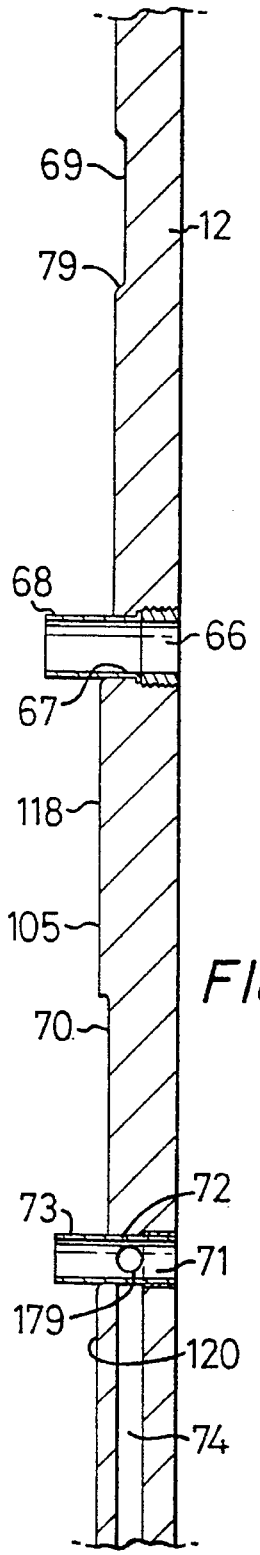
FIG. 1E is a side cross-sectional view of a body member of the tool of FIG. 1A.

The body member 12 as shown in FIGS. 1A and 1E has the central channel 13 through its center. Upper threads 63 threadedly engage an upper sub 14 and lower threads 64 permit connection of the tool 10 to a piece of casing or other tubular below the tool 10. One or more circulation ports 66 are formed through the body member 12, each having a metal liner 67 which has an inwardly projecting portion 68. Near the top of the body member 12 is a locking dog recess 69. A snap ring recess 70 is located between the circulation ports 66 and an inflation port 71. The inflation port 71 has a metal liner 72 with a portion 73 extending inwardly. A fluid passageway 74 extends from a hole 79 in the liner 72 down to and adjacent an inflatable packer 16. A check value 75 abuts an inner shoulder 76 of the body member 12 and has a ball 78 spring-loaded upwardly by a spring 77 so that fluid for inflating the packer 16 must be of sufficient force to overcome the force of the spring and so that, once the packer 16 is inflated, fluid inflating the packer 16 cannot flow back out the passageway 74.

Figure 1B:
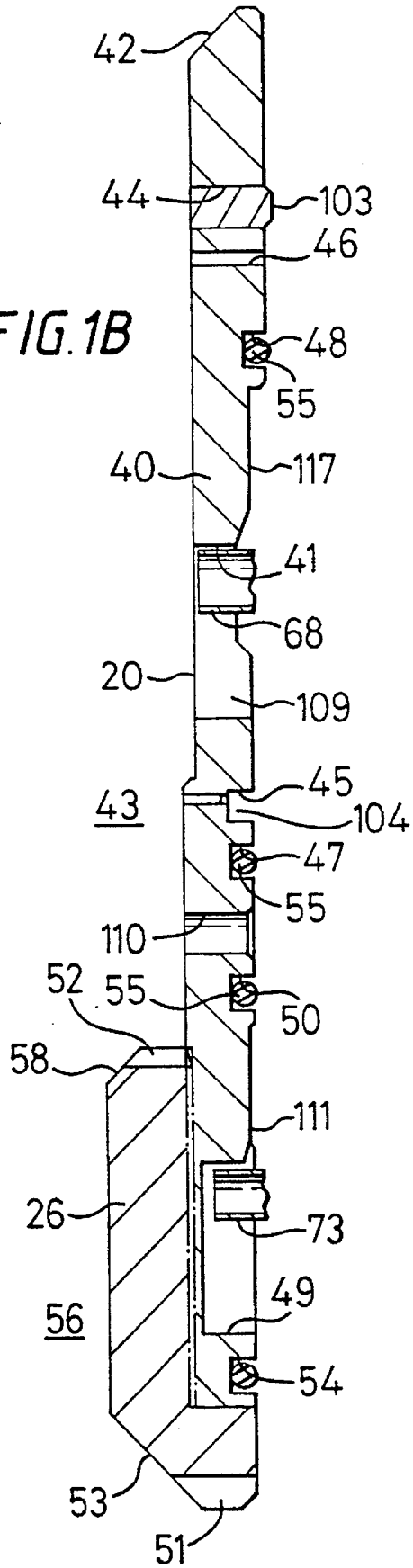
FIG. 1B is a side cross-sectional view of a drive sleeve of the tool of FIG. 1A.

As shown in FIGS. 1A and 1B, the drive sleeve 20 has a body 40 with a top shoulder 42 and a bottom end 51. A locking dog recess 44 is configured to receive a locking dog and a shear pin recess 46 is configured to receive a shear pin. Various o-ring recesses 47, 48, 50, and 54 are configured to receive and hold sealing o-rings 55. A port liner slot 41 is configured to receive an extending portion 68 of a port liner 67. A central channel 43 extends through the body 40 of the drive sleeve 20. A snap ring recess 45 is configured to receive and hold a snap ring and an inflation port slot 49 is configured to receive an extending portion 73 of an inflation port liner 72. A drive sleeve seat 26 with a top 52 and a bottom 53 is threadedly secured within the bottom of the drive sleeve 20. A central channel 56 extends through the drive sleeve seat 26.

Figure 1C:
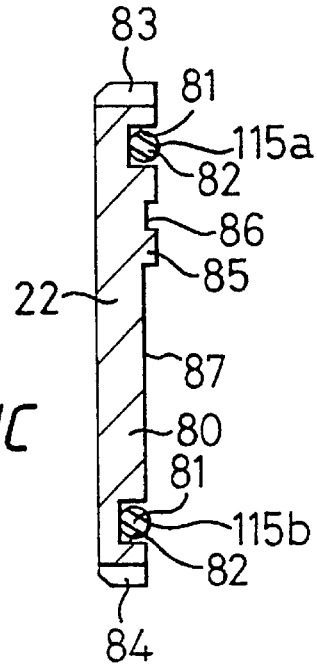
FIG. 1C is a side cross-sectional view of a communication sleeve of the tool of FIG. 1A.

A communication sleeve 22 shown in FIGS. 1A and 1C has a body 80; O ring recesses 81 for O-rings 82; a top 83; a bottom 84; a shoulder 85; and a groove 86 for a shear pin. The diameter of the sleeve 22 at point 115a is greater than its diameter at 115b creating an effective piston area. There is a recessed area 87 on the sleeve.

Figure 1D:
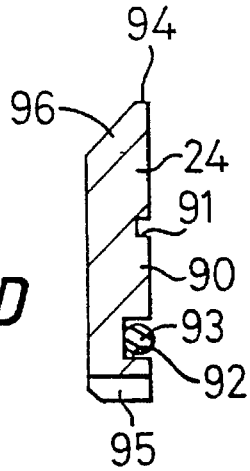

A closing sleeve 24 as shown in FIGS. 1A and 1D has a body 90; a shear pin groove 91; an O-ring recess 92 with O-ring 93; a top 94; a bottom 95; and an upper seat surface 96.

FIGS. 7–10 show a sequence of operation for the stage tool 10 shown in FIGS. 1A–1E.

Figure 7:
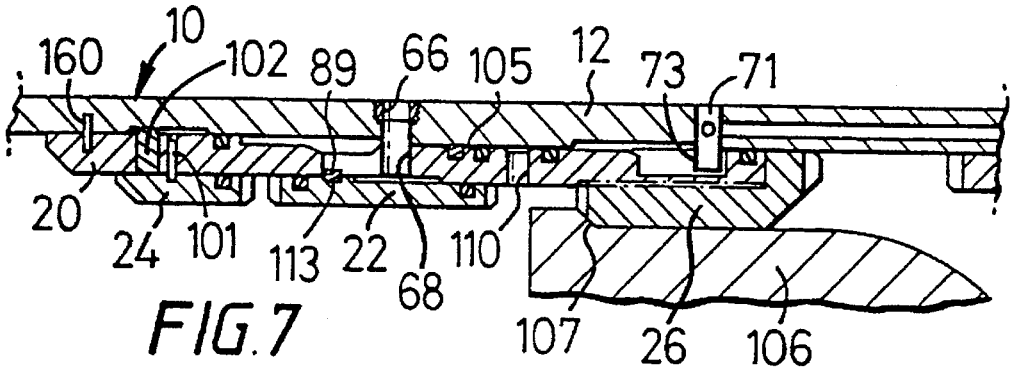
FIGS. 7–10 are side views in cross-section which depict a sequence of operation of a tool according to the present invention.
Figure 8:
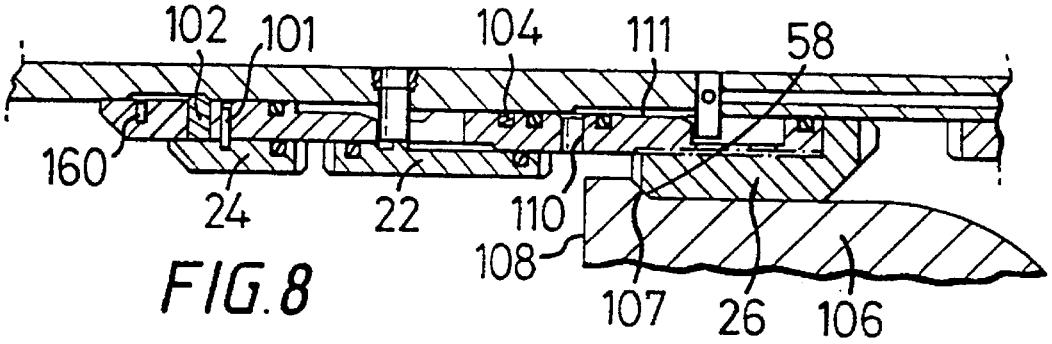

FIG. 7 illustrates the tool 10 as it rests in a wellbore prior to any functioning of the various movable parts. The communication sleeve 22 with its associated O-ring seals blocks fluid flow through the circulation ports 66 and the drive sleeve blocks flow through the inflation port 71. A shear pin 101 holds the closing sleeve 24 in place with respect to the drive sleeve 20. A locking dog 102 is disposed in the locking dog recess 44 in the drive sleeve 20 with a tip end 103 extending into the locking dog recess 69 of the body member. A snap ring 104 is disposed in the snap ring recess 45 of the drive sleeve 20 and abuts a surface 105 of the body member which prevents the snap ring from snapping outwardly. One or more shear pins 160 which extend from the drive sleeve into the body member hold the drive sleeve 20 immobile with respect to the body member 12o By inserting a flexible plug into the casing and moving it to seat at a point below the stage tool to seal off flow through the stage tool, sufficient hydraulic pressure can be applied to the drive sleeve's piston area (formed by differential diameters between top and bottom of the sleeves) to actuate it. If a flexible cementing plug initially pumped down to seat against a seat below the stage tool seat (e.g. but not limited to a seat on a float shoe), fails to seat properly so that sufficient hydraulic pressure cannot be brought to bear on the drive sleeve piston surface, then in a mechanical operation mode of the stage tool an opening bomb (e.g. bomb 106) is used. An opening bomb 106 (shown partially) has a bomb seat surface 107 which seats against a seating surface 58 on the drive Sleeve seat 26. As shown in FIG. 8 the opening bomb has not yet moved the drive sleeve 20 downwardly (to the right in FIG. 7). A shear pin 113 extends from a shear pin recess 89 in the drive sleeve 20 and into a shear pin groove 86 in the communication sleeve 22 to initially hold the two sleeves immovable with respect to each other. As shown in FIG. 8, fluid pressure applied on an end surface 108 of the bomb 106 has caused the bomb 106 to move the drive sleeve 20 downwardly. The locking dogs 102 have moved to abut the locking dog shoulder 79 of the body member 12. The extending portions 68 of the port liners 67 have moved in corresponding slots 109 in the drive sleeve 20 and flow of fluid under pressure has commenced through a drive sleeve port 110, into the snap ring recess 70 of the body member 12, past surface 111 of the drive sleeve 20 into the slot 49 of the drive sleeve 20 which accommodates the inflation port 71, into the inflation port 71, through the hole 179, and thence into the passageway 74 through the body member 12 to the packer 16.

Figure 9:
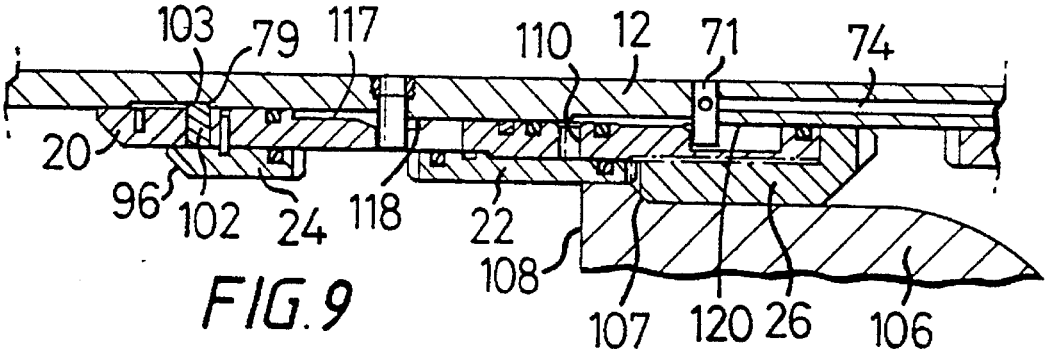

As shown in FIG. 9 fluid pressure from the surface acts on the effective piston area of the communication sleeve 22 has moved the communication sleeve 22 downwardly to abut the top 52 of the drive sleeve seat 26, thus uncovering the open end of the circulation ports 66 and permitting fluid flow from within the tool 10, out through the ports 66, and into the annulus (not shown) outside the stage tool 10. Flow is now prevented through the drive sleeve port 110 resulting in a cessation of fluid flow to the packer 16. Due to the blocking disposition of the communication sleeve about the drive sleeve port 110, enhanced by the O-ring seals 82, well fluids, (cement, etc.) does not flow through the path that fluid previously flowed to inflate the packer 16. Thus items along this path are no longer subjected to any injurious effects of such fluids.

Figure 10:
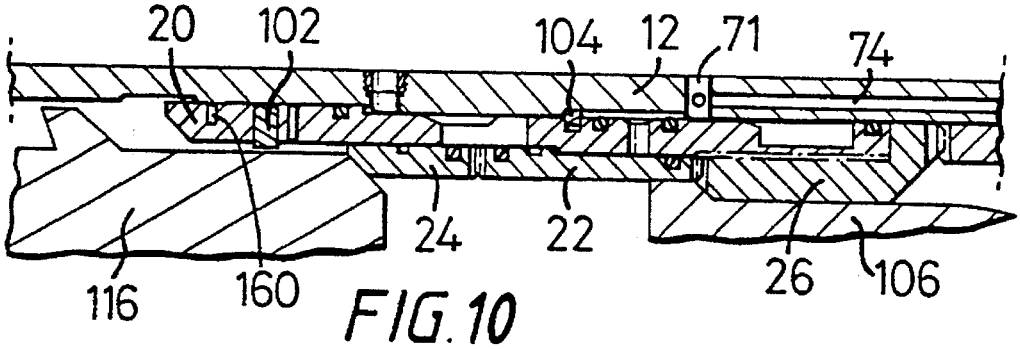
Figure 11:
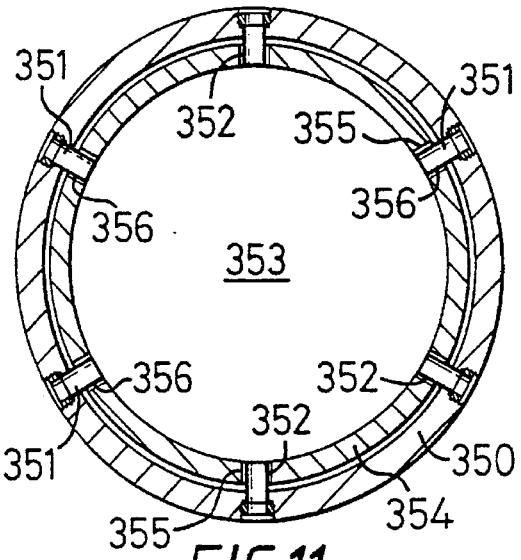
FIG. 11 is a top cross-sectional view of a tool according to the present invention.
Figure 12:
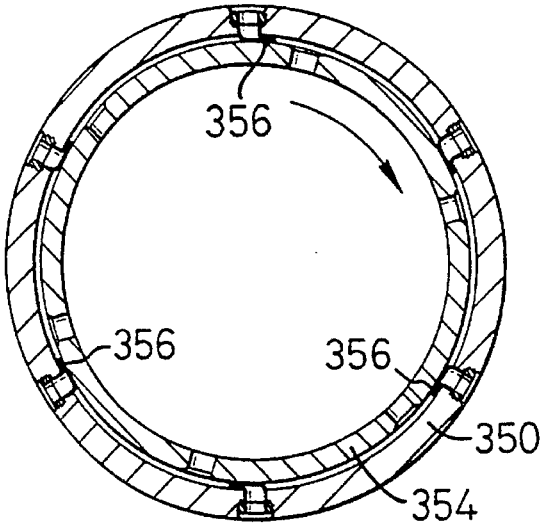
FIG. 12 is an enlargement of part of the tool of FIG. 11.

As shown in FIG. 10 a closing plug 116 has been inserted within the casing and pumped down into the tool 10 to abut the seat surface 96, pushing the closing sleeve 24 to abut the communication sleeve 22; and then to push the three sleeves further downwardly forcing the drive sleeve 20 to move so that the extending portions 68 of the circulation port liner 67 are crushed shut into metal-to-metal sealing configuration by a surface 117 of the drive sleeve 20 and a surface 118 of the body member 12; and the extending portion 73 of the inflation port liner 72 is crushed shut into metal-to-metal sealing configuration by a surface 111 of the drive sleeve 20 and a surface 120 of the body member 12. This shuts off the flow of fluid from within the tool 10 to the annulus of the wellbore, and vice versa, and shuts off fluid flow to the packer.

Figure 2:
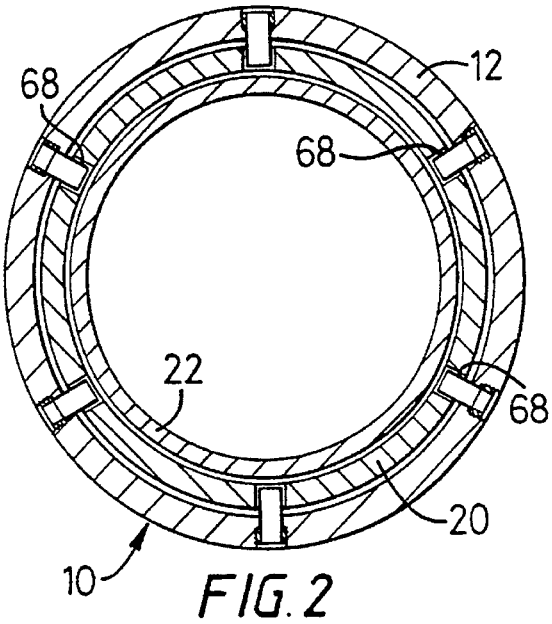
FIG. 2 is a top view in cross=section along line 2—2 of FIG. 1.
Figure 4:
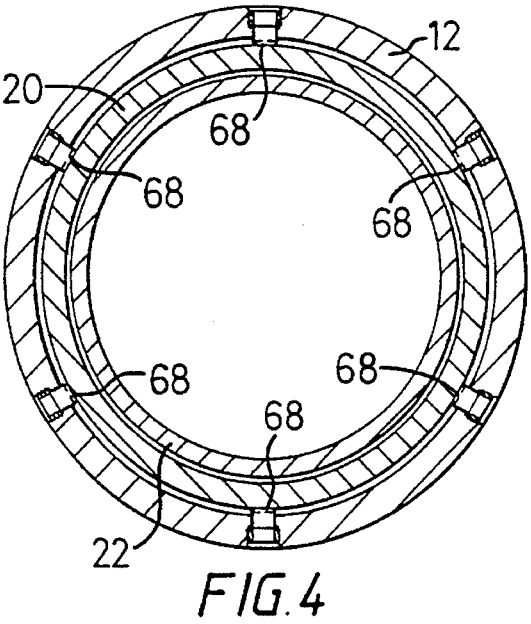
FIG. 4 is a to view in cross-section along line 2—2 of FIG. 1.
Figure 3:
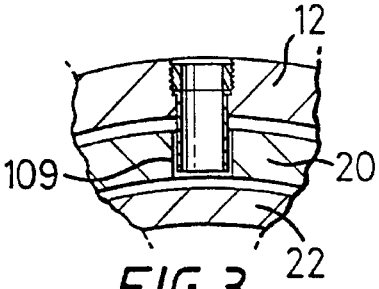
FIG. 3 is an enlarged view of a portion of the tool of FIG. 2 invention.
Figure 5:
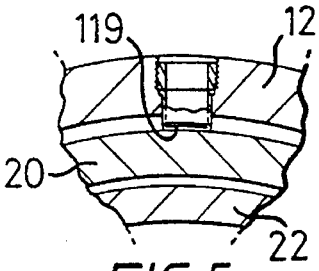
FIG. 5 is an enlarged view of a portion of the tool of FIG. 4.

FIGS. 2–5 show in detail port liner extensions 68 prior to and after crushing. FIGS. 2 and 3 show the liner extensions 68 projecting into slots 109 of the drive sleeve 20 of the tool 10. FIGS. 4 and 5 show the crushed liner extensions following downward movement of the drive sleeve 20 as previously described. A crushed portion 119 of the liner extension 68 shown in FIG. 5 is sealed shut due to formation of a metal-to-metal seal of crushed portions of the liner extension.

Figure 6:
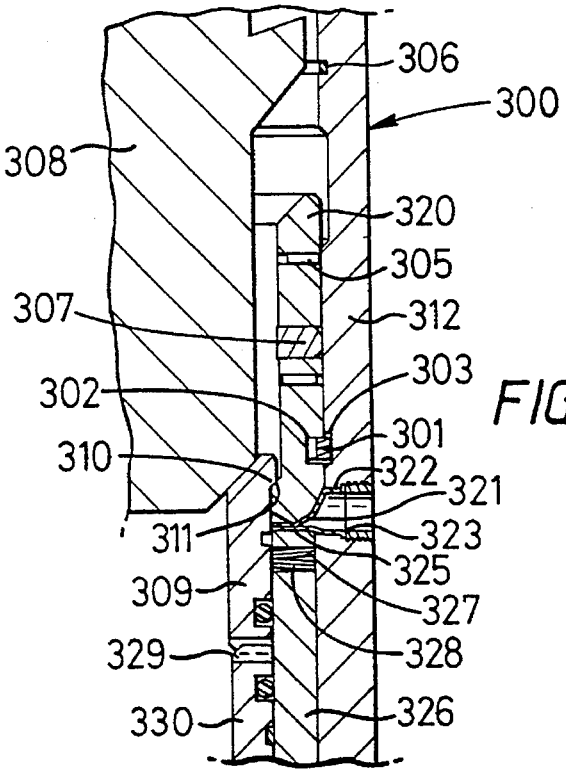
FIG. 6 is a side view in cross-section of a tool according to the present invention.

FIGS. 6 illustrates a stage tool 300 similar to the stage tool 10 but with an upper drive sleeve 320 which is forced downwardly to crush an extending liner portion 321 of a liner 322 of a port 323. The port 323 extends through a tool body member 312 (like the body member 12 previously described) and a snap ring 301 originally disposed in a snap ring drive sleeve recess 302 has moved partially into a snap ring recess 303 in the body member 312 to hold the upper drive sleeve 320 immobile with respect to the body member 312. Prior to movement of the upper drive sleeve 320, a shear pin 305 extending partially into a shear pin recesses 306 in the body member 312 held the upper drive sleeve 320 immobile with respect to the body member 312. A locking dog 307 acts in a manner similar to the locking dog 102 described previously. A plug 308 pumped down the casing contacts a closing sleeve 309, moving it down so that a shoulder 310 contacts a shoulder 311 of the upper drive sleeve 320. Continued force on the plug 308 breaks the shear pin 305 and moves the upper drive sleeve 320 down, crushing the liner extension 321 against a top surface 325 of a lower member 327. The lower member 327 is forced upwardly by a spring 328 which is biased against a lower sleeve 326 which is secured to the body member 312. Downward movement of the closing sleeve 309 ceases when it abuts a top 329 of a communication sleeve 330 similar to the communication sleeve 22 described previously.

Figure 13:
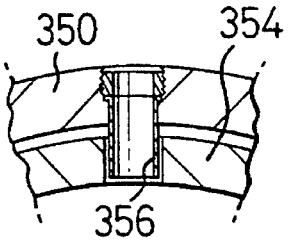
FIG. 13 is a top view of the tool of FIG. 11 after rotation of an innerdrive ring.
Figure 14:
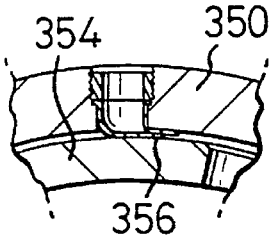
FIG. 14 is an enlargement of part of the tool of FIG. 13.

FIGS. 11–14 illustrate an alternative method for crushing port liner extensions. A ported tubular 350 according to the present invention has a plurality of lined ports 351, each with a port liner 352 having a liner extension 356 extending into a central portion 353 of the tubular 350. A rotatable drive ring 354 is disposed within the tubular 350 and has recesses 355 (similar to the slots 109) into which extend a portion of the liner extensions 356. In FIG. 13 the drive ring 354 has been rotated rather than forced downwardly to crush the liner extensions 356 (like extensions 68 previously described). The sleeve 120 may be rotated by inserting a tubular member in the casing to contact, engage, and then rotate the drive ring 354.

Figure 15:
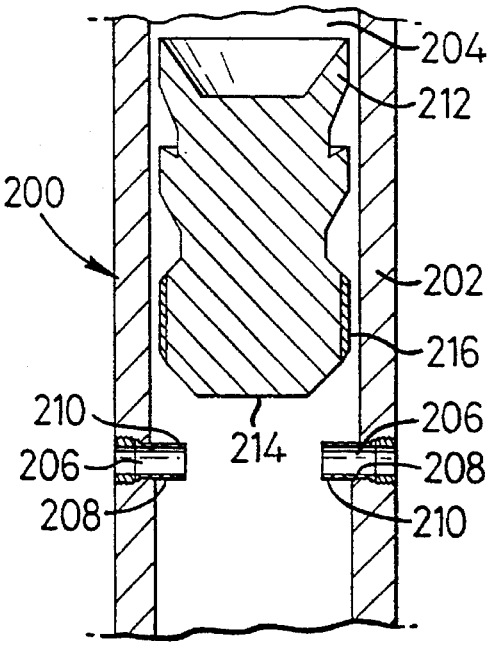
FIGS. 15 and 16 are side views in cross-section of a ported tubular according to the present invention with a lined port according to the present invention and of a tubular port closing system according to the present invention.
Figure 16:
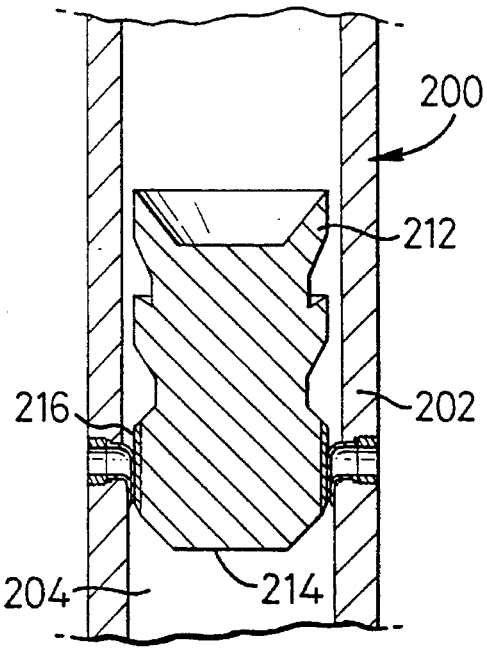

FIGS. 15 and 16 illustrate a ported tubular 200 according to the present invention with a hollow body member 202 through which extends a central flow channel 204. One or more circulation ports 206 formed through the body member 202 permit fluid flow from the interior of the body member 202 to the space outside of it or vice versa. Each port 206 has a metal liner 208 secured therein (e.g. by press fit, threaded engagement, adhesive, etc.) which has an extending metal portion 210. Any suitable apparatus may be employed to crush the liner extensions 210. As shown in FIG. 16, a plug 212, preferably with a hardened and/or metal nose 214 with a hardened and/or metal circumferential sleeve or integral side area 216 has been inserted into the central channel 204. Either by the force of gravity, by fluid pressure against a top surface 218 of the plug 212, or both, the plug 212 is forced against the liner extensions 210 crushing them shut in a metal-to-metal sealing configuration as shown in FIG. 16.

Figure 17:
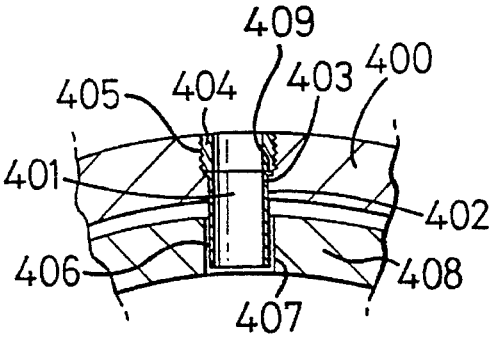
FIGS. 17–22 are top views in cross-section of lined ports according to the present invention.

FIGS. 17–22 illustrate a variety of ports and port liners according to the present invention. FIG. 17 illustrates a ported tubular 400 according to the present invention with a port 401 with an interior surface 402 of the port 401. A metal port liner 403 lines a portion of the interior surface 402 and is secured in place within the port 401 by a threaded nut 404 which threadedly engages threads 405 of the port 401 and abuts a flange 409 of the port liner 403. A crushable metal liner extension 406 extends from the port 401 into a recess 407 in a crushing member 408 (e.g. a drive ring as previously described.) Of course the liner extension 406 could be crushed by any suitable means (e.g. but not limited to a plug or drive sleeve as described previously.)

Figure 18:
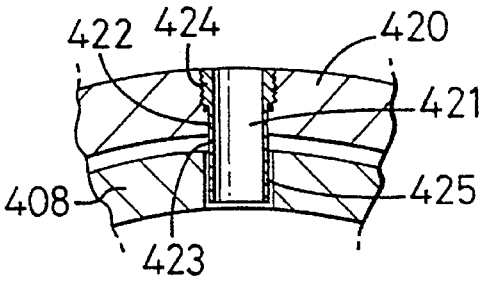

FIG. 18 illustrates a ported tubular 420 with a port 421 lined with a port liner 422 which is a single integral piece having a liner portion 423, a crushable metal extension 425, and a threaded nut portion 424. The crushing member 408 is shown with the liner extension therein.

Figure 19:
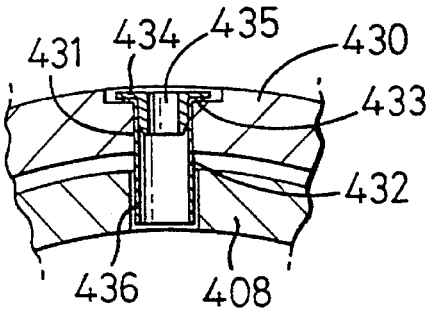

FIG. 19 illustrates a ported tubular 430 with a port 431 lined with a metal port liner 432 having a flange 433 against which is press fit a hollow headed plug 434. The plug 434 has a central bore 435. The liner 432 has a crushable metal extension 436. The crushing member 408 is shown with the liner extension therein.

Figure 20:
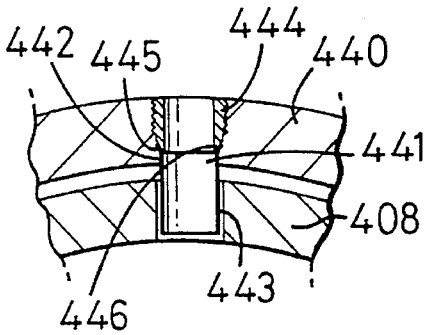

FIG. 20 illustrates a ported tubular 440 with a port 441 lined with a metal port liner 442 which has a crushable metal liner extension 443. A threaded nut 444 with a cone end 445 holds the port liner 442 in the port 441. The cone end seals against an end 446 of the liner 442. The crushing member 408 is shown with the liner extension therein.

Figure 21:
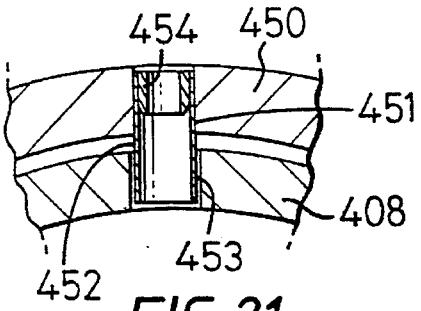

FIG. 21 illustrates a ported tubular 450 with a port 451 lined with a metal port liner 452 which has a crushable metal liner extension 453. A hollow plug 454 which is press fit into the liner 452 to secure it in the port 451 and to seal the liner against the interior surface of the port 451. The crushing member 408 is shown with the liner extension therein.

Figure 22:
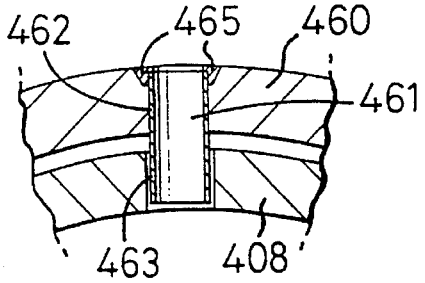

FIG. 22 illustrates a ported tubular 460 with a port 461 lined with a metal port liner 462 and having a crushable metal liner extension 463 which projects into the tubular 460. The liner 462 is welded, soldered, or glued around its outer periphery to hold it in place in the port 461. Preferably a seal is formed around the liner's outer periphery at the area of adhesion. The crushing member 408 is shown with the liner extension therein.

Figure 23:
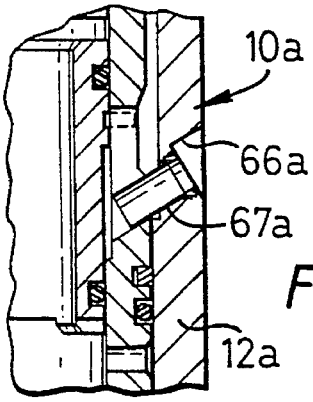
FIG. 23 is a partial side cross-sectional view of a tool according to this invention.

FIG. 23 illustrates a tool 10a like the tool 10 described previously, but the body member 12a has circulation ports 66a with a port liner 67a at an angle (an angle to horizontal as viewed in FIG. 23). It is within the scope of this invention to provide lined ports and tools or tubulars therewith with lined ports and associated liners at any practical angle with respect to a body of the tool or tubular.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A metal-to-metal sealing apparatus for sealing a port through a wall member, the apparatus comprising at least one hollow port through the wall member for the passage of fluid from a first side of the wall member to a second opposite side of the wall member, the at least one hollow port having a channel therethrough defined by a port interior surface, and a hollow metal liner disposed within the channel of the at least one hollow port and lining the interior surface of the port, the fluid flowable through the hollow metal liner, the hollow metal liner having a hollow metal extending liner portion projecting beyond the at least one hollow port on one side of the wall member, the hollow metal extending liner portion being sealingly crushable so that upon crushing of the hollow metal extending liner portion fluid flow through the channel of the at least one hollow port is prevented.

2. The metal-to-metal sealing apparatus of claim 1 further comprising plug apparatus for sealingly securing the hollow metal liner within the at least one hollow port.

3. The metal-to-metal sealing apparatus of claim 2 wherein the plug apparatus is threaded to mate with threads of the wall member.

4. A method for sealing a hollow fluid-flow port through a wall member, the port defined by an interior port surface and having a metal liner disposed therethrough, the metal liner having a hollow sealingly crushable metal extending liner portion projecting from the port, the port extending through the wall member and the hollow crushable metal extending liner portion projecting beyond the wall member, the method comprising moving a crushing member to contact and then to crush the hollow sealingly crushable metal extending liner portion, and forming a metal-to-metal seal by crushing the hollow sealingly crushable metal extending liner portion thereby preventing fluid flow through the port.

* * * * *